US006756944B2

(12) United States Patent
Tessier et al.

(10) Patent No.: US 6,756,944 B2
(45) Date of Patent: Jun. 29, 2004

(54) ANTENNA FOR VEHICLE

(75) Inventors: Virginie Tessier, Monza (IT); Jean Lexuan, Noisy le Grand (FR); Omar Meradi, Bromsgrove (GB)

(73) Assignee: Valeo Electronique, Creteil (FR)

( * ) Notice: Subject to any disclaimer, the term of this patent is extended or adjusted under 35 U.S.C. 154(b) by 13 days.

(21) Appl. No.: 10/030,967

(22) PCT Filed: May 14, 2001

(86) PCT No.: PCT/FR01/01487

§ 371 (c)(1),
(2), (4) Date: Jan. 15, 2002

(87) PCT Pub. No.: WO01/89033

PCT Pub. Date: Nov. 22, 2001

(65) Prior Publication Data

US 2002/0105468 A1 Aug. 8, 2002

(30) Foreign Application Priority Data

May 15, 2000 (FR) ..... 00 06320

(51) Int. Cl.[7] ..... H01Q 1/32
(52) U.S. Cl. ..... 343/713

(58) Field of Search ..... 343/711–713, 741, 343/866

(56) References Cited

U.S. PATENT DOCUMENTS

| | | | | |
|---|---|---|---|---|
| 2,520,986 A | * | 9/1950 | Williams et al. | 343/712 |
| 3,154,786 A | * | 10/1964 | Clanton | 343/713 |
| 5,896,111 A | | 4/1999 | Houdeau et al. | 343/867 |

FOREIGN PATENT DOCUMENTS

| | | |
|---|---|---|
| DE | 44 31 603 A | 3/1996 |
| FR | 2 766 016 A | 1/1999 |
| JP | 57 186802 A | 11/1982 |

* cited by examiner

*Primary Examiner*—Michael C. Wimer
(74) *Attorney, Agent, or Firm*—Liniak, Berenato & White

(57) ABSTRACT

Flat-top antenna emitting and/or receiving an electromagnetic field, particularly for a motor vehicle, formed of multi-strand conductors connected one by one to form turns. The flat-top antenna is positioned on a mechanical support so that it is mainly at right angles to the surface defined by the turns. Hands-free access and starting system may comprise such an antenna.

16 Claims, 3 Drawing Sheets

ANTENNA FOR VEHICLE

BACKGROUND OF THE INVENTION

The present invention relates to the incorporation of an emitting and/or receiving flat-top antenna into a mechanical support particularly in a motor vehicle.

More specifically, the invention relates to the positioning of a flat-top antenna that is of a large size with respect to a mechanical support present in a motor vehicle.

What happens is, the need for communication—emission and/or receiving of information—between the vehicle and elements external to the vehicle, such as remote controls or interactive badges for hands-free access systems entail the use of large-sized antennas which are incorporated in particular into the roof, into the floor, or into the console inside the vehicle.

Flat-top antennas consisting of n multi-strand conductors connected one by one by a connector are currently known and are produced using methods known to those skilled in the art. Document JP 57186802 discloses in particular the use of such an arrangement as an antenna.

It is also known practice for antennas of the flat-top type to be positioned out flat on a surface-type mechanical support. Document EP 0 780 027 discloses the incorporation of a flat-top antenna into a small-sized flat rectangular surface. The arrangement described entails folding the flat-top at 45°.

Making folds at 45° is a complicated and lengthy process, particularly when incorporating large-sized flat-top antennas into extensive flat surfaces such as, for example, the roof or the floor of a motor vehicle.

The purpose of the invention is to integrate a flat-top antenna into a, preferably surface-type, mechanical support while at the same time limiting the interference that is due to bringing the antenna to face metallic walls such as the roof or the floor of a motor vehicle.

It is also important to be able to reduce the installation time and simplify the incorporation of such an antenna.

The invention achieves its objective by the use of a flat-top antenna emitting and/or receiving an electromagnetic field, particularly for a motor vehicle, formed of multi-strand conductors connected one by one to form turns. The flat-top antenna is characterized in that it is positioned on a mechanical support so that it is mainly at right angles to the surface defined by the turns.

The invention is also advantageously supplemented by the various characteristics of the secondary claims taken alone or in any of their technically feasible combinations.

- the flat-top antenna is positioned so that it is mainly at right angles to the mechanical support, the surface of the mechanical support corresponding to the surface of the turns,
- the mechanical support consists of a piece of non-metallic material,
- the mechanical support consists of at least two juxtaposed pieces,
- the flat-top antenna is held on the mechanical support by mechanical holding means,
- the holding means are positioned on the mechanical support,
- the holding means are positioned on one or more adjacent walls mainly perpendicular to the mechanical support of the antenna,

- the holding means are produced in the form of a groove produced in or on the mechanical support,
- the holding means are produced in the form of a clip positioned on the mechanical support or on a wall adjacent to the mechanical support,
- the holding means are produced in the form of staples,
- the antenna is bonded to the mechanical support or to a wall adjacent to the mechanical support,
- the antenna is incorporated directly into the support by molding,
- the flat-top antenna is incorporated into a vehicle equipped with a hands-free access and/or starting system.

Thanks to the installation of the antenna according to the invention it becomes possible for the antenna to be positioned quickly and in a limited number of stages.

In addition, by limiting the area of the antenna facing the metal walls, the interference phenomena that may occur are reduced.

Other features and advantages of the invention will become further apparent from the description which follows. This description is purely illustrative and nonlimiting. It is to be read in conjunction with the appended figures in which:

DETAILED DESCRIPTION OF THE INVENTION

Figure 1A:
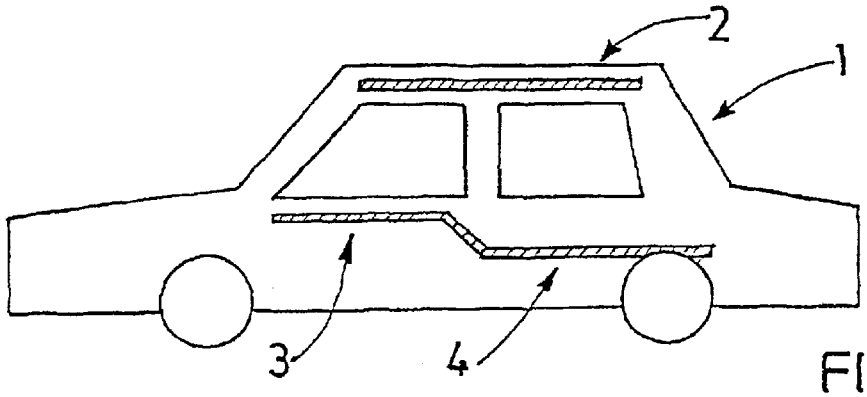
FIG. 1*a* is a view in section of a motor vehicle showing possible surfaces for incorporation of a flat-top antenna according to the invention
Figure 1B:
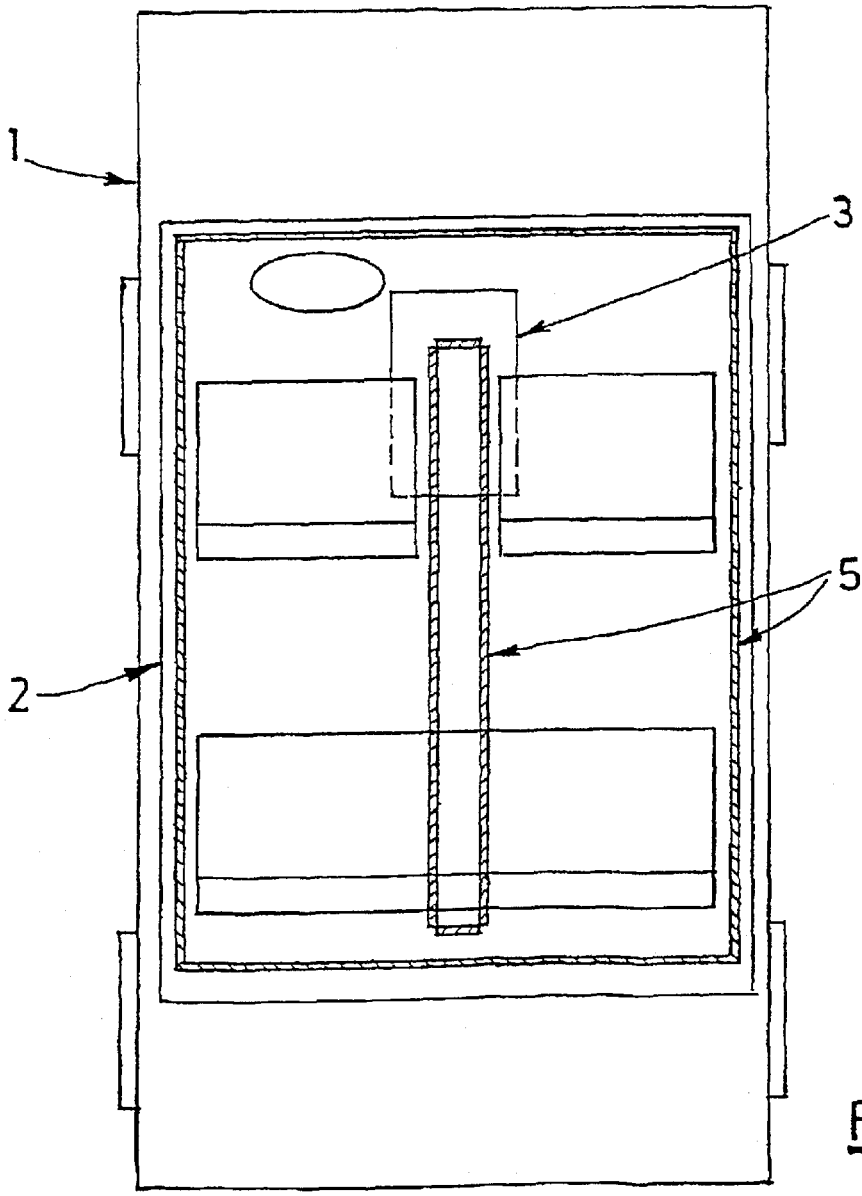
FIG. 1*b* is a view from above of a motor vehicle showing the possible incorporation surfaces of FIG. 1*a,*

FIGS. 1*a* and 1*b* show, in two different sections, a motor vehicle 1. They show several options for incorporating a flat-top antenna 5 at various locations in the vehicle, particularly in the roof 2, in the console 3 and in the floor 4. It is advantageous to cover the console 3 and the floor 4 with one and the same antenna, so as to avoid destroying the field and to save on one driver.

It is also possible to cover the console and the floor independently using two flat-top antennas, taking care to control the radiating patterns of the two antennas.

The shape of the antenna thus formed is rectangular, but could be circular, square or any other shape, and its method of incorporation makes it possible to avoid folding.

The flat-top antenna according to the invention is incorporated by positioning the flat-top antenna so that it is mainly at right angles to the surface defined by the turns of said antenna. This surface defined by the turns of the antenna corresponds, in the case of the roof of the vehicle, of the console, of the floor or of the console—floor entity, to the surface-type mechanical support on which the flat-top antenna is positioned. Thus, the flat-top antenna is in a position which on the whole is at right angle to the surface-type mechanical support.

If the antenna is positioned on the console/floor entity, the flat-top antenna is placed on two juxtaposed mechanical supports which are not in the same plane but which correspond to a surface equivalent to that defined by the turns of the antenna.

Once positioned, the flat-top antenna is held on this support by holding means.

Figure 2B:
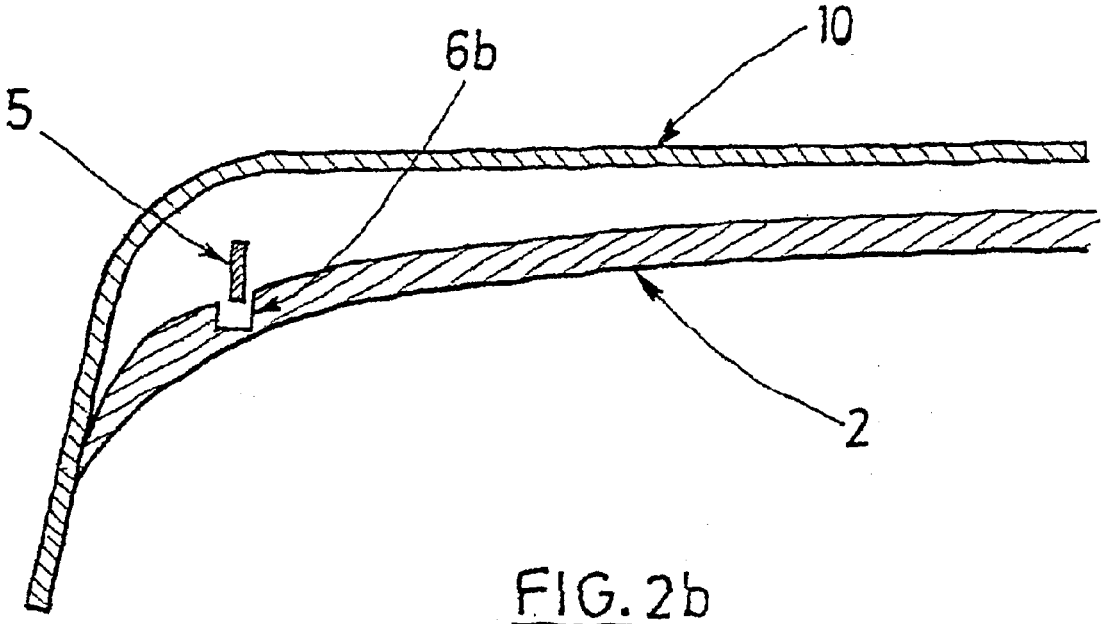
FIGS. 2*a* and 2*b* are views in section of the roof of a motor vehicle showing the incorporation and holding of a flat-top antenna according to the invention.
Figure 2A:
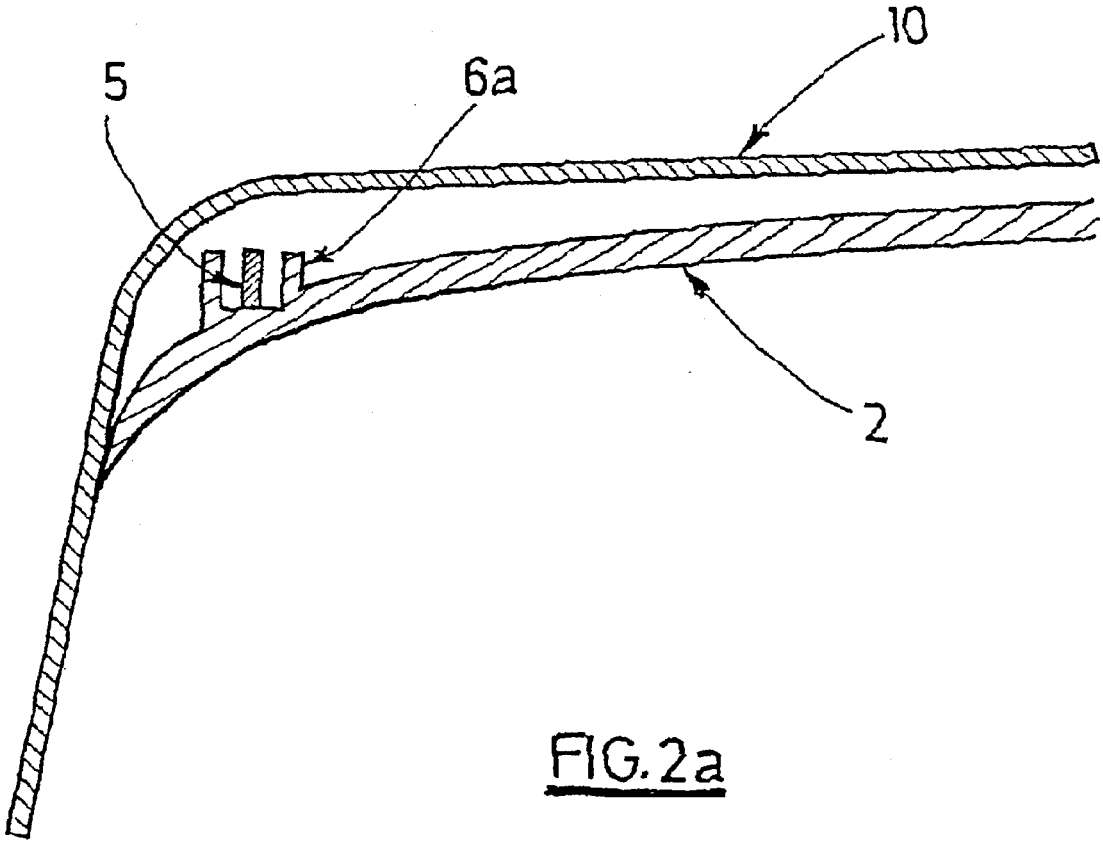

The means of holding the antenna on the mechanical support shown in FIGS. 2*a* and 2*b* form an integral part of the support.

In FIG. 2*a*, the holding means are produced in the form of a groove 6*a* formed at the surface of the top side of the roof. This groove is produced around the entire periphery of the roof so that the flat-top antenna can be incorporated into the roof 10 of a motor vehicle. The groove 6*a* allows the flat-top antenna to be accommodated and held in a position that is mainly at right angles to the surface defined by the turns, that is to say, in this arrangement, with respect to the roof which forms the mechanical support of the flat-top antenna. The groove 6*a* is made directly at the surface on the roof when the latter is manufactured. It is also possible to provide an independent groove that is then bonded onto the roof. FIG. 2*a* shows the use of a groove 6*a* on the roof of a motor vehicle, but this type of groove can be positioned at other locations on the vehicle such as, for example, the floor, the door pillars, etc. as need be.

FIG. 2*b* depicts a second embodiment of the groove. The groove 6*b* is produced directly in the mass of the roof and consists in a local recess of rectangular cross section running around the entire periphery of the roof. Obviously, this groove 6*b* could be produced in other locations on the vehicle to accommodate a flat-top antenna.

Figure 3B:
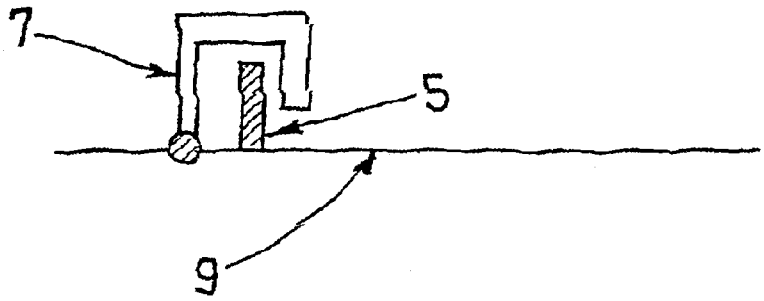
FIGS. 3*a* and 3*b* are views in section of another means of holding the flat-top antenna incorporated into a motor vehicle.
Figure 3A:
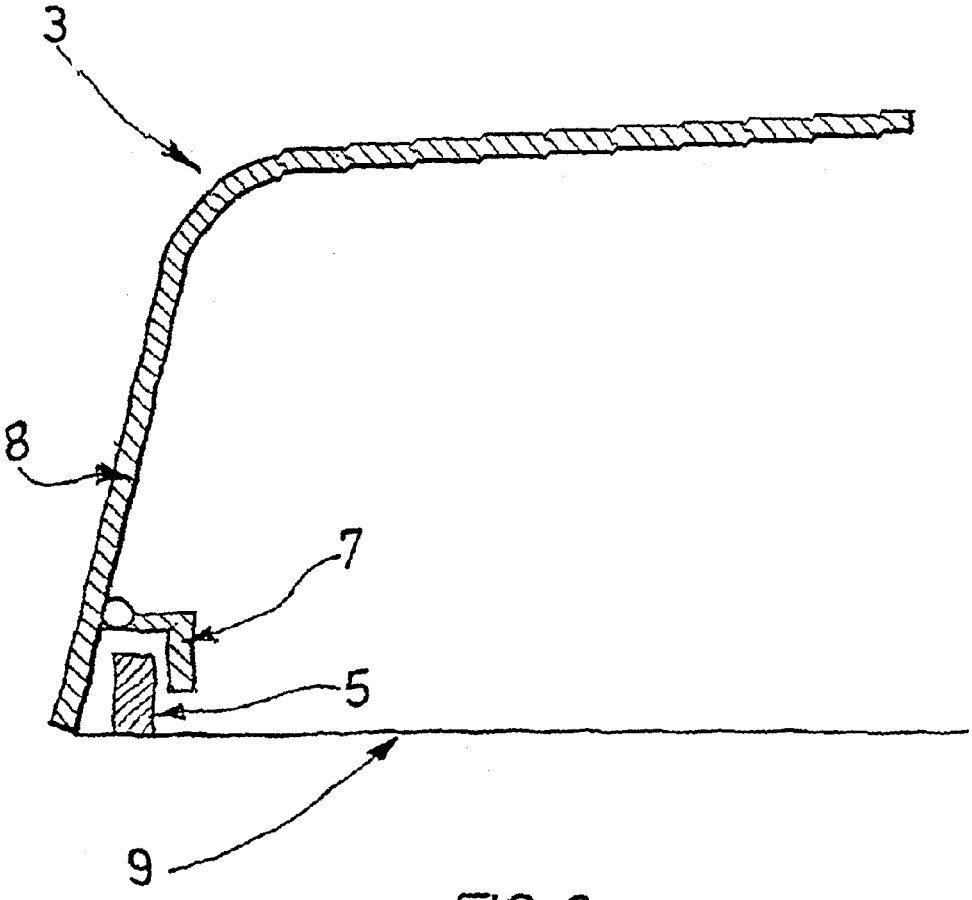

FIG. 3*a* depicts another means of holding the flat-top antenna on an interior console of the motor vehicle. This holding means is a clip 7 positioned on a wall of the console 3, this wall 8 is adjacent to the mechanical support 9 on which the flat-top antenna is placed. This clip 7, preferably made of plastic, is fixed via a hinge to the adjacent wall 8 of the console 3. Prior to positioning the flat-top antenna on the mechanical support 9, the clip is in the open position and is awaiting the insertion of the flat-top antenna 5. When the flat-top antenna has been positioned, the clip 7 is folded down onto it to hold it in place and press it between the wall 8 and the mechanical support 9.

This configuration for holding the flat-top antenna using a clip 7 has been illustrated on the console inside the vehicle, but could be produced in numerous other locations on the vehicle.

FIG. 3*b* also shows holding means produced in the form of a clip 7, this clip being positioned directly on the mechanical support 9. It is therefore not necessary to have an adjacent wall to use a clip as a means of positioning the flat-top antenna on the mechanical support.

The means of holding the flat-top antenna on its mechanical support, so that it is positioned mainly at right angles to the surface defined by the turns, can be produced in various ways. In particular, the flat-top antenna may be stapled or bonded directly to its mechanical support or to a wall adjacent to the mechanical support. These solutions have the advantage of being quick but entail the presence of several operators to install the antenna—one operator to position the antenna, and one operator to staple or bond it to its support.

A more advantageous solution is to incorporate the flat-top antenna directly at the time of manufacture of its mechanical support, particularly when it is intended to be incorporated into a roof or into an element such as the floor of the vehicle. The antenna can thus be molded directly at the time of manufacture of its support element.

What is claimed is:

1. A flat-top antenna assembly for emitting and/or receiving an electromagnetic field, the flat-top antenna assembly comprising:

a mechanical support having a surface; and a flat-top antenna comprising a plurality of turns of multi-strand conductors extending parallel to one another and stacked on one another to define a height dimension of the flat-top antenna, each of the turns defining a respective turn surface, the multi-strand conductors connected end-to-end with one another wherein the height dimension of the flat-top antenna is positioned mainly at a right angle to the turn surface and to the surface of the mechanical support, the flat-top antenna is positioned on the surface of the mechanical support and a weight of the flat-top antenna is supported by the mechanical support.

2. A flat-top antenna assembly according to claim 1, wherein the height dimension of the flat-top antenna is positioned transversely to the mechanical support, the surface of the mechanical support corresponding to the antenna turn surface.

3. A flat-top antenna assembly according to claim 2, wherein the mechanical support consists of a piece of non-metallic material.

4. A flat-top antenna assembly according to claim 3, wherein the mechanical support consists of at least two juxtaposed pieces.

5. A flat-top antenna assembly according to claim 4, further comprising mechanical holding means for holding the flat-top antenna on the mechanical support.

6. A flat-top antenna assembly according to claim 5, wherein the holding means are positioned on the mechanical support.

7. A flat-top antenna assembly according to claim 5, wherein the holding means are positioned on one or more adjacent walls mainly perpendicular to the mechanical support of the antenna.

8. A flat-top antenna assembly according to claim 7, wherein the holding means comprise a groove in or on the mechanical support.

9. A flat-top antenna assembly according to claim 7, wherein the holding means comprise a clip positioned on the mechanical support or on a wall adjacent to the mechanical support.

10. A flat-top antenna assembly according to claim 7, wherein the holding means comprise staples.

11. A flat-top antenna assembly according to claim 7, wherein the flat-top antenna is bonded to the mechanical support or to a wall adjacent to the mechanical support.

12. A flat-top antenna assembly according to claim 5, wherein the flat-top antenna is incorporated directly into the support by molding.

13. Hands-free access and/or starting system comprising a flat-top antenna assembly as claimed in 12.

14. A flat-top antenna assembly according to claim 1, wherein the mechanical support forms part of a body of a motor vehicle.

15. A flat-top antenna assembly according to claim 14, wherein the motor vehicle has a floor, and wherein the flat-top antenna is incorporated into the floor of the motor vehicle.

16. A flat-top antenna assembly according to claim 14, wherein the motor vehicle has a roof, and wherein the flat-top antenna is incorporated into the roof of the motor vehicle.

* * * * *